US009217976B2

(12) United States Patent
Kondo

(10) Patent No.: US 9,217,976 B2
(45) Date of Patent: Dec. 22, 2015

(54) IMAGE FORMING APPARATUS

(71) Applicant: FUJI XEROX CO., LTD., Tokyo (JP)

(72) Inventor: Takayuki Kondo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/263,192

(22) Filed: Apr. 28, 2014

(65) Prior Publication Data

US 2015/0098743 A1 Apr. 9, 2015

(30) Foreign Application Priority Data

Oct. 8, 2013 (JP) ..... 2013-211154

(51) Int. Cl.
*G03G 15/00* (2006.01)
*G03G 15/16* (2006.01)

(52) U.S. Cl.
CPC ..... *G03G 15/6529* (2013.01); *G03G 15/657* (2013.01); *G03G 15/1605* (2013.01)

(58) Field of Classification Search
CPC ... G03G 15/00; G03G 15/16; G03G 15/6529; G03G 15/6555
USPC ..... 399/388, 389
See application file for complete search history.

(56) References Cited

U.S. PATENT DOCUMENTS

2007/0008395 A1* 1/2007 Masubuchi ..... G03G 15/0131 347/104
2009/0324305 A1 12/2009 Udaka et al.
2010/0019440 A1* 1/2010 Fujiwara ..... G03G 15/6511 271/10.02
2010/0034565 A1* 2/2010 Ashikawa ..... G03G 15/0131 399/302
2011/0158690 A1* 6/2011 Mimbu et al. ..... 399/121
2012/0008991 A1* 1/2012 Shimizu ..... G03G 15/1675 399/297
2012/0121293 A1* 5/2012 Mimbu ..... G03G 15/161 399/121
2012/0189358 A1* 7/2012 Echigo ..... 399/302

FOREIGN PATENT DOCUMENTS

JP 09062116 A * 3/1997 ..... G03G 15/16
JP 10254204 A * 9/1998 ..... G03G 15/00
JP 2000025989 A * 1/2000 ..... G03G 15/00
JP A-2000-155479 6/2000
JP 2011133542 A * 7/2011 ..... G03G 15/16
JP B2-4725607 7/2011
JP A-2012-51699 3/2012

* cited by examiner

*Primary Examiner* — Nguyen Ha
(74) *Attorney, Agent, or Firm* — Oliff PLC

(57) ABSTRACT

An image forming apparatus includes a toner-image carrying member, a transfer unit that transfers the toner image on the toner-image carrying member onto a recording medium at a transfer portion, a transport roller disposed along a transport direction to transport the recording medium to the transfer portion while being in contact with the recording medium, and a release unit that releases the contact of the transport roller with the recording medium. The release unit does not release the contact of the transport roller when it is detected that the recording medium passing through the transport roller is a thick recording medium or a recording medium having a high bending strength, and releases the contact when the recording medium is different from the thick recording medium and the recording medium having a high bending strength. The release unit releases the contact before a leading edge of the recording medium reaches the transfer portion.

9 Claims, 8 Drawing Sheets

IMAGE FORMING APPARATUS

CROSS-REFERENCE TO RELATED APPLICATIONS

This application is based on and claims priority under 35 USC 119 from Japanese Patent Application No. 2013-211154 filed Oct. 8, 2013.

BACKGROUND (i) Technical Field

The present invention relates to an image forming apparatus.

(ii) Related Art

There has been a demand to form an image on a recording medium, such as thick paper, as well as plain paper in order to meet various user needs.

SUMMARY

According to an aspect of the invention, there is provided an image forming apparatus including a toner-image carrying member that carries a toner image, a transfer unit that transfers the toner image carried on the toner-image carrying member onto a recording medium at a transfer portion, a transport roller disposed along a transport direction to transport the recording medium to the transfer portion of the transfer unit while being in contact with the recording medium, and a release unit that releases the contact of the transport roller with the recording medium. The release unit does not release the contact of the transport roller with the recording medium when it is detected that the recording medium passing through the transport roller is a thick recording medium or a recording medium having a high bending strength, and releases the contact when the recording medium is different from the thick recording medium and the recording medium. The release unit releases the contact before a leading edge of the recording medium reaches the transfer portion.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

First Exemplary Embodiment

Figure 1:
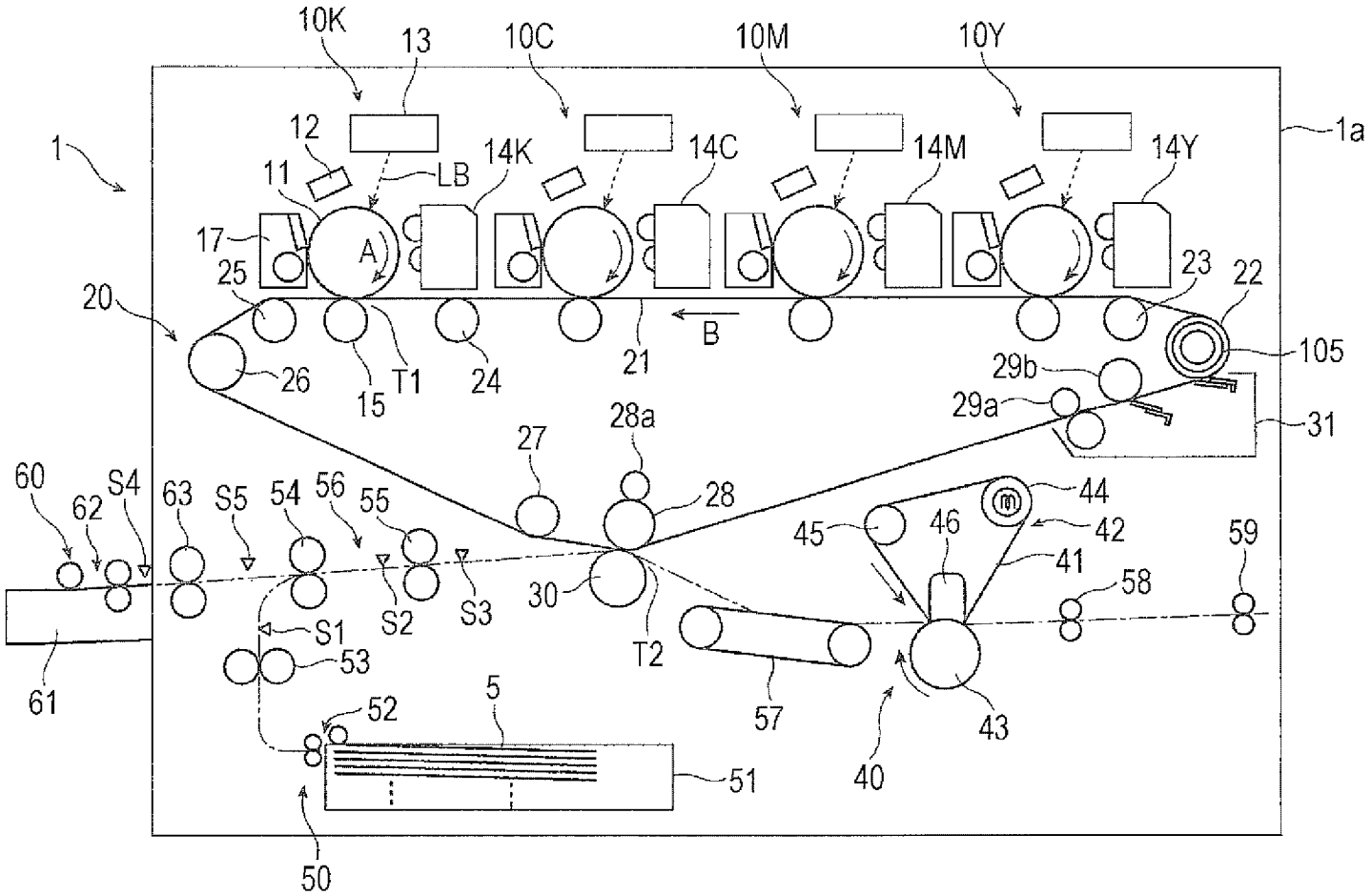
FIG. 1 is a schematic structural view of an image forming apparatus according to a first exemplary embodiment of the present invention.
Figure 2:
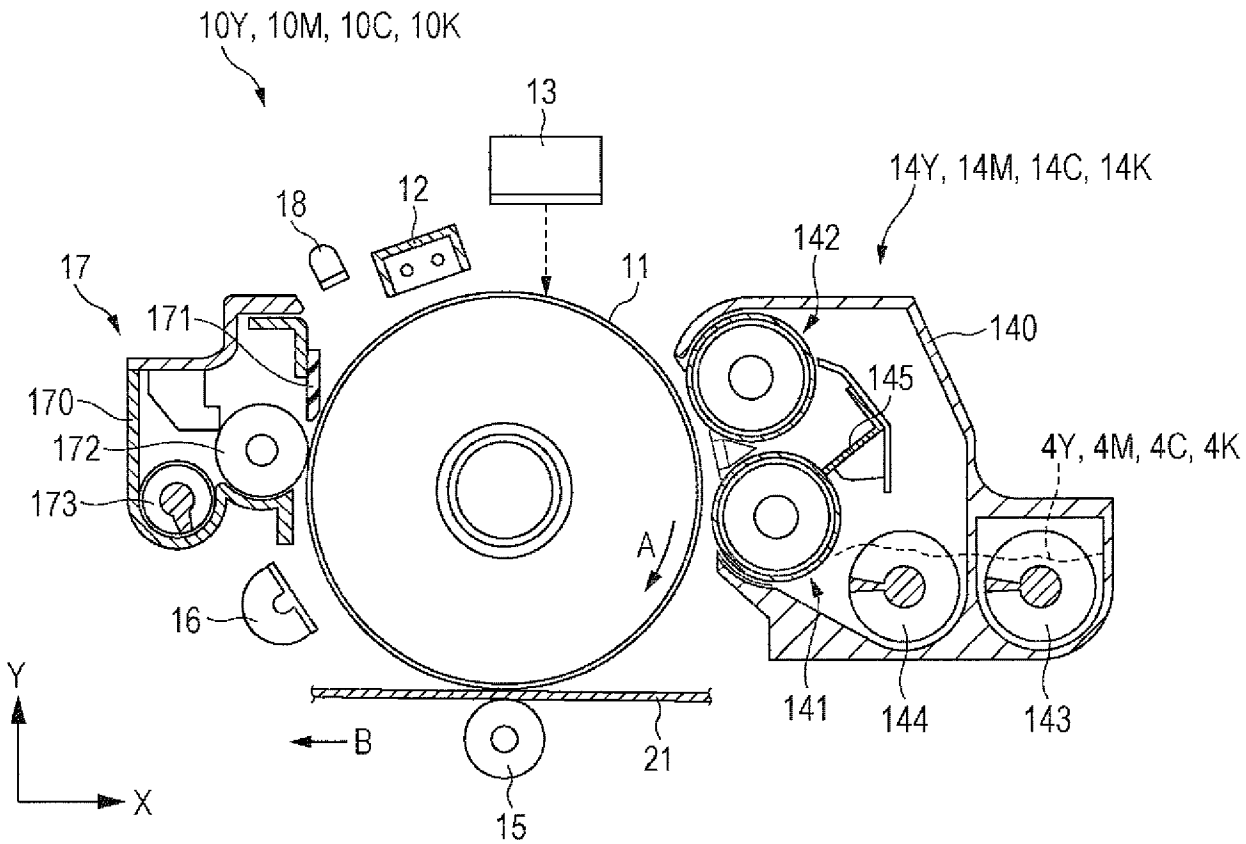
FIG. 2 is a structural view of an image forming device in the image forming apparatus according to the first exemplary embodiment.
Figure 3:
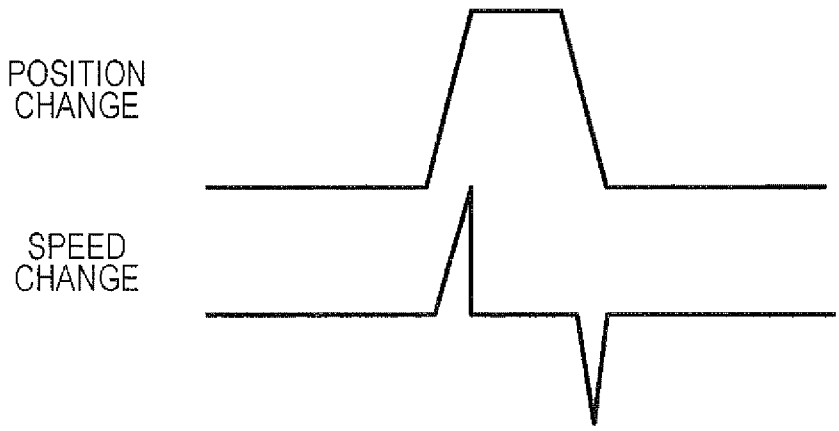
FIG. 3 is an explanatory view illustrating a state in which changes are caused in an intermediate transfer belt when a recording medium enters a second transfer portion.

FIGS. 1 and 2 illustrate an image forming apparatus according to a first exemplary embodiment of the present invention. FIG. 1 illustrates an overall configuration of the image forming apparatus, and FIG. 2 is an enlarged view of the principal part of the image forming apparatus (for example, an image forming device).

Overall Configuration of Image Forming Apparatus

An image forming apparatus 1 according to a first exemplary embodiment is configurated as a color printer for example. The image forming apparatus 1 includes plural image forming devices 10, an intermediate transfer device 20, a paper feed device 50, and a fixing device 40. The image forming devices 10 serve as image forming units each for forming a toner image developed with toner contained in developer 4. The intermediate transfer device 20 carries toner images formed by the image forming devices 10, and finally transports the toner images to a second transfer position where the toner images are to be second-transferred onto recording paper 5 serving as an example of a recording medium. The paper feed device 50 stores and transports required recording paper 5 to be supplied to the second transfer position of the intermediate transfer device 20. The fixing device 40 fixes the toner images second-transferred by the intermediate transfer device 20 onto the recording paper 5.

For example, the image forming apparatus 1 can be configurated as a color copying machine when it is additionally provided with an unillustrated image input device through which a document image to be formed on the recording paper 5 is input. Referring to FIG. 1, a housing 1*a* of the image forming apparatus 1 is composed of a support structure member, an outer covering, etc. In FIG. 1, a one-dot chain line shows a transport path through which the recording paper 5 is transported in the housing 1*a*.

Structure of Principal Part of Each Image forming Device

The image forming devices 10 are formed by four image forming devices 10Y, 10M, 10C, and 10K that form toner images of four colors, yellow (Y), magenta (M), cyan (C), and black (K), respectively. These four image forming devices 10 (10Y, 10M, 10C, 10K) are arranged in line in an inner space of the housing 1*a*.

As illustrated in FIGS. 1 and 2, each of the image forming devices 10 (10Y, 10M, 10C, 10K) includes a rotatable photoconductor drum 11. Around the photoconductor drum 11, the following devices are arranged. These devices are a charging device 12, an exposure device 13, a developing device 14, a first-transfer device 15, a pre-cleaning charging device 16, a drum cleaning device 17, and a charge eliminator 18. The charging device 12 charges a peripheral surface (image carrying surface) of the photoconductor drum 11, on which an image can be formed, with a required potential. The exposure device 13 forms an electrostatic latent image having a potential difference (for the corresponding color) by radiating light LB based on image information (signals) onto the charged peripheral surface of the photoconductor drum 11. The developing device 14 forms a toner image by developing the electrostatic latent image with toner of developer 4 of the corresponding color (Y, M, C, K). The first-transfer device 15 transfers each toner image onto the intermediate transfer device 20. The pre-cleaning charging device 16 charges attached substances, such as toner, remaining on and attached to the image carrying surface of the photoconductor drum 11 after first transfer. The drum cleaning device 17 cleans off the recharged attached substances. The charge eliminator 18 eliminates charge from the image carrying surface of the photoconductor drum 11 after cleaning.

The photoconductor drum 11 includes a grounded base material shaped like a cylinder or a column, and an image carrying surface provided on a peripheral surface of the base material. The image carrying surface includes a photoconductive layer (photosensitive layer) formed of a photosensitive material. The photoconductor drum 11 is supported to be rotated in a direction of arrow A by power transmitted from an unillustrated rotational driving device.

The charging device 12 is formed by a non-contact charging device, such as a corona discharger, disposed out of contact with the photoconductor drum 11. Charging voltage is supplied to a discharging member of the charging device 12. When the developing device 14 performs reversal development, a voltage or current having the same polarity as the charging polarity of toner supplied from the developing device 14 is supplied as the charging voltage.

The exposure device 13 forms an electrostatic latent image by radiating light LB (shown by an arrowed dotted line) based on image information input to the image forming apparatus 1 onto the charged peripheral surface of the photoconductor drum 11. When a latent image is formed, information (signals) about an image input to the image forming apparatus 1 by an arbitrary method is transmitted to the exposure device 13.

As illustrated in FIG. 2, each developing device 14 (14Y, 14M, 14C, 14K) includes a casing 140 having an opening and a reservoir for the developer 4. Within the casing 140, two developing rollers 141 and 142, two agitating and transport members 143 and 144 such as screw augers, a layer-thickness regulating member 145, etc. are arranged. The developing rollers 141 and 142 carry and transport the developer 4 to two developing areas opposed to the photoconductor drum 11. The agitating and transport members 143 and 144 agitate and transport the developer 4 such that the developer 4 passes along the developing roller 142. The layer-thickness regulating member 145 regulates the amount (layer thickness) of developer to be carried on the developing roller 141. In the developing device 14, developing voltage is supplied between the developing rollers 141 and 142 and the photoconductor drum 11 from an unillustrated power supply device. The developing rollers 141 and 142 and the agitating and transport members 143 and 144 are rotated in required directions by power transmitted from an unillustrated rotational driving device. Further, as the developer 4 of four colors (Y, M, C, K), a two-component developer containing nonmagnetic toner and magnetic carries is used.

The first transfer device 15 is a contact-type transfer device including a first-transfer roller that rotates in contact with the peripheral surface of the photoconductor drum 11 and receives first-transfer voltage. As the first-transfer voltage, a direct-current voltage having a polarity opposite from the toner charging polarity is supplied from the unillustrated power supply device.

As illustrated in FIG. 2, the drum cleaning device 17 includes a body 170, a cleaning plate 171, a rotary brush roller 172, and a feed member 173 such as a screw auger. The body 170 is shaped like a container that is partly open. The cleaning plate 171 is disposed in contact with the peripheral surface of the photoconductor drum 11 with a required pressure after first transfer, and cleans off attached substances such as residual toner. The rotary brush roller 172 is disposed on an upstream side of the cleaning plate 171 in a rotating direction of the photoconductor drum 11 to rotate in contact with the peripheral surface of the photoconductor drum 11. The feeding member 173 collects the attached substances, such as toner, cleaned off by the cleaning plate 171 and, feeds the attached substances to an unillustrated recovery system. As the cleaning plate 171, a platelike member (for example, a blade) formed of, for example, rubber is used.

As illustrated in FIG. 1, the intermediate transfer device 20 is disposed below the image forming devices 10 (10Y, 10M, 10C, 10K). The intermediate transfer device 20 includes an intermediate transfer belt 21, plural belt support rollers 22 to 29, a second-transfer device 30, and a belt cleaning device 31. The intermediate transfer belt 21 serves as a toner-image carrying member that rotates in a direction of arrow B while passing through first-transfer positions between the photoconductor drums 11 and the first-transfer devices 15 (first transfer rollers). The belt support rollers 22 to 29 hold the intermediate transfer belt 21 from an inner side in a desired state, and support the intermediate transfer belt 21 rotatably. The second-transfer device 30 is disposed on an outer peripheral surface (image carrying surface) side of the intermediate transfer belt 21 supported by the belt support roller 28, and second-transfers toner images on the intermediate transfer belt 21 onto recording paper 5. The belt cleaning device 31 cleans off attached substances, such as toner and paper dust, remaining on and attached to the outer peripheral surface of the intermediate transfer belt 21 after the intermediate transfer belt 21 passes over the second transfer device 30.

As the intermediate transfer belt 21, for example, an endless belt is used which is formed of a material in which a resistance adjustment agent, such as carbon black, is dispersed in synthetic resin such as polyimide resin or polyamide resin. The belt support roller 22 is formed as a driving roller, and the belt support rollers 23, 24, 25, 27, 29*a*, and 29*b* are formed as driven rollers that hold a running position of the intermediate transfer belt 21. The belt support roller 26 is formed as a tensioning roller, and the belt support roller 28 is formed as a backup roller for second transfer. The belt support roller 22 serving as the driving roller is rotationally driven by an unillustrated driving unit.

As illustrated in FIG. 1, the second-transfer device 30 is formed by a contact-type second-transfer device including a second-transfer roller that contacts a second transfer position (transfer portion) T2 in a portion of the outer peripheral surface of the intermediate transfer belt 21 supported by the belt support roller 28 in the intermediate transfer device 20. A direct-current voltage having a polarity opposite from or identical to the toner charging polarity is supplied as second-transfer voltage to the second transfer roller 30 or the belt support roller 28 of the intermediate transfer device 20. When the second-transfer voltage is applied to the belt support roller 28 of the intermediate transfer device 20, for example, it is applied using a voltage application roller 28a disposed in contact with a peripheral surface of the belt support roller 28.

In the fixing device 40, a heating rotating body 42 and a pressurizing rotating body 43 are disposed within an unillustrated casing having an entrance and an exit for recording paper 5. The heating rotating body 42 includes a fixing belt 41 that rotates in a direction of an arrow and is heated by a heater to keep a surface temperature at a predetermined temperature.

The pressurizing rotating body 43 is shaped like a roller that is driven by contact with the heating rotating body 42 with a predetermined pressure almost along an axial direction of the heating rotating body 42. The heating rotating body 42 includes the fixing belt 41, a heating roller 44 that supports the fixing belt 41 rotatably, a tensioning roller 45 that applies tension to the fixing belt 41, and a pressing member 46 that presses the fixing belt 41 against the pressing roller serving as the pressurizing rotating body 43 from an inner side. In the fixing device 40, a contact portion (nip) where the heating rotating body 42 contacts the pressurizing rotating body 43 serves as a fixing portion, where a required fixing operation (heating and pressing) is performed.

The paper feed device 50 is disposed below the intermediate transfer device 20 and the second-transfer device 30. The paper feed device 50 includes a single (or plural) paper container 51 that stores sheets of recording paper 5 of a desired size, type, etc. in a stacked state, and a feeding device 52 that feeds out the sheets of recording paper 5 one by one from the paper container 51. For example, the paper container 51 is attached to be drawn out to a front side of the housing 1*a* (a side surface the user faces during operation).

Between the paper feed device 50 and the second-transfer device 30, a fed-paper transport device 56 is provided as a transport device. The fed-paper transport device 56 includes plural paper transport rollers 53 to 55 that transport recording paper 5 fed out from the paper feed device 50 to the second-transfer position T2, and unillustrated transport guide members. In the fed-paper transport device 56, the paper transport roller 55 disposed immediately before the second-transfer position T2 is provided as a roller (registration roller) that adjusts the position of the recording paper 5 reaching the second-transfer position T2, for example, by controlling the transport time of the recording paper 5. The paper transport roller 54 disposed upstream of the paper transport roller 55 is provided as a pre-registration roller. Between the second-transfer device 30 and the fixing device 40, a paper transport device 57 shaped like a belt or the like is provided to transport the recording paper 5 sent from the second-transfer roller of the second transfer device 30 to the fixing device 40 after second transfer. At an exit of the fixing device 40, an output roller 58 is provided to output the recording paper 5 after fixing. Further, in a portion near a paper output port provided in the housing 1*a*, a paper output roller 59 is provided to output the recording paper 5, which is sent by the output roller 58 of the fixing device 40 after fixing, to the outside of the housing 1*a*.

A manual paper feed device 60 is provided on one side surface of the housing 1*a*. The manual paper feed device 60 includes a stacker 61 on which sheets of recording paper 5 of a desired size, type, and the like are stacked, a feeding device 62 that feeds the sheets of recording paper 5 one by one from the stacker 61, and a paper transport roller 63 that transports the sheets of recording paper 5, which are fed out one by one by the feeding device 62, to the fed-paper transport device 56. In sheet transport paths of the fed-paper transport device 56 and the manual paper feed device 60, paper sensors S1 to S5 are disposed to detect the recording paper 5. The paper sensor S1 is disposed downstream of the paper transport rollers 53, the paper sensor S2 is disposed upstream of the paper transport roller 55, and the paper sensor 53 is disposed downstream of the paper transport roller 55. The paper sensor S4 is disposed downstream of the feeding device 62, and the paper sensor S5 is disposed downstream of the paper transport roller 63.

Operations of Entirety and Principal Part of Image Forming Apparatus

A basic image forming operation of the image forming apparatus 1 will be described below.

Here, a description will be representatively given of an image forming operation of forming a full-color image by combining toner images of four colors (Y, M, C, K) using the above-described four image forming devices 10 (10Y, 10M, 10C, 10K).

When the image forming apparatus 1 receives information about an image-forming-operation (printing) request command, the four image forming devices 10 (10Y, 10M, 10C, 10K), the intermediate transfer device 20, the second transfer roller 30, the fixing device 40, etc. start.

In each of the image forming devices 10 (10Y, 10M, 10C, 10K), the photoconductor drum 11 first rotates in the direction of arrow A, and the charging device 12 charges the surface of the photoconductor drum 11 with required polarity (a negative polarity in the first exemplary embodiment) and potential. Subsequently, the exposure device 13 radiates, onto the charged surface of the photoconductor drum 11, light LB that is emitted on the basis of image signals obtained by converting image information input to the image forming apparatus 1 into color components (Y, M, C, K), and thereby forms an electrostatic latent image of the corresponding color component with the required potential difference on the surface of the photoconductor drum 11.

Next, each of the developing devices 14 (14Y, 14M, 14C, 14K) develops the electrostatic latent image formed on the photoconductor drum 11 by supplying toner of the corresponding color (Y, M, C, K) from the developing rollers 141 and 142 and electrostatically attaching the toner to the electrostatic latent image. By this development, electrostatic latent images corresponding to the color components formed on the photoconductor drums 11 are visualized as toner images of four colors (Y, M, C, K) developed with the corresponding color toners.

Next, when the color toner images formed on the photoconductor drums 11 in the image forming devices 10 (10Y, 10M, 10C, 10K) are transported to the first-transfer positions, the first-transfer devices 15 sequentially first-transfer and superpose the color toner images onto the intermediate transfer belt 21 rotating in the direction of arrow B in the intermediate transfer device 20.

After first transfer is completed, in each of the image forming devices 10, the pre-cleaning charging device 16 recharges attached substances, such as toner, remaining on the surface of the photoconductor drum 11, the drum cleaning device 17 scrapes off the recharged attached substances to clean the surface of the photoconductor drum 11, and finally, the charge eliminator 18 eliminates the charge from the cleaned surface of the photoconductor drum 11. Thus, the image forming devices 10 are brought into a state ready for the next image forming operation.

Next, in the intermediate transfer device 20, the first-transferred toner images are held and transported to the second-transfer position T2 by rotating the intermediate transfer belt 21. In contrast, the paper feed device 50 feeds out required recording paper 5 to the fed-paper transport device 56 in accordance with the image forming operation. In the fed-paper transport device 56, the paper transport roller 55 serving as the registration roller feeds and supplies the recording paper 5 to the second-transfer position T2 in synchronization with the transfer time.

At the second-transfer position T2, the second-transfer device 30 second-transfers the toner images on the intermediate transfer belt 21 onto the recording paper 5. After the second transfer, the belt cleaning device 31 in the intermediate transfer device 20 cleans off attached substances, such as toner, remaining on the surface of the intermediate transfer belt 21.

Next, the recording paper 5 on which the toner images are second-transferred is separated from the intermediate transfer belt 21 and the second-transfer device 30, and is then transported to the fixing device 40 by the paper transport device 57. In the fixing device 40, the recording paper 5 after second transfer is introduced and passed through the contact portion (nip) between the rotating heating rotating body 42 and the pressurizing rotating body 43, so that the unfixed toner images are fixed on the recording paper 5 by a required fixing operation (heating and pressurization). Finally, in an image forming operation of forming an image on one side of the recording paper 5, the recording paper 5 is output after fixing into, for example, an unillustrated output receiver disposed outside the housing 1*a* by the output roller 58 and the paper output roller 59.

Through the above-described procedure, a full-color image is formed on the recording paper 5 by combining four color toner images, and the recording paper 5 is output.

Structure of Characteristic Part of Image Forming Apparatus

As the recording paper 5 used in the image forming apparatus 1, not only plain paper, but also thick paper having a basis weight more than that of plain paper is given as an example. In recent years, thick paper having basis weights within a wide range of 250 to 500 g/m$^2$ has been used in correspondence with diversification of user needs. For example, recording paper 5 made of thick paper is fed from the paper container 51 when it has a comparatively small basis weight, and is fed from the manual paper feed device 60 when it has a comparatively large basis weight. However, the recording paper 5 of thick paper may be fed from the paper container 51. The stiffness of thick paper tends to be higher than that of plain paper and to increase as the basis weight increases.

Figure 4:
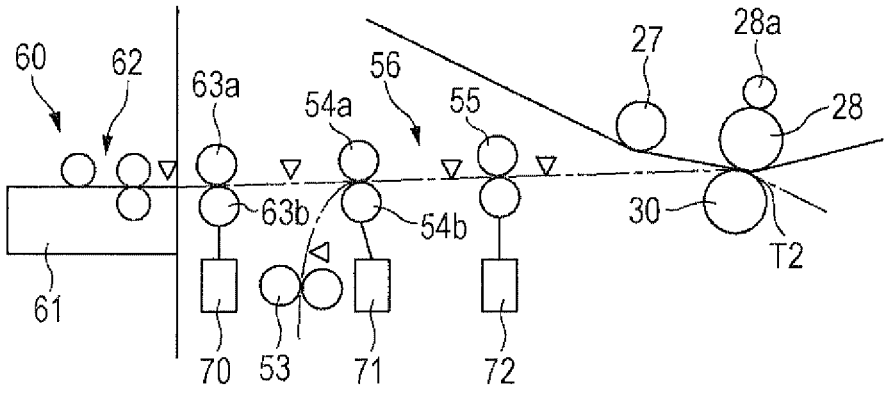
FIG. 4 is a structural view of a transport device for the recording medium.

For this reason, in a case in which an image is to be formed on recording paper 5 made of thick paper having a large basis weight, when the recording paper 5 enters the second-transfer position T2 where the second-transfer roller 30 is in pressing contact with the belt support roller 28 (backup roller) with the intermediate transfer belt 21 being disposed therebetween, it is thrust by transport force of the paper transport roller 63 of the manual paper feed device 60 and so on, as illustrated in FIG. 4, to assist in transport of the intermediate transfer belt 21. However, if the transport force of the paper transport rollers becomes too large, the transport force for the recording paper 5 at the second-transfer position T2 rapidly increases, and vibration is transmitted to the first-transfer positions T1. This causes degradation of image quality, such as a color shift, of images that are being transferred from the photoconductor drums 11 onto the intermediate transfer belt 21. Further, after a trailing edge of the recording paper 5 passes through the paper transport roller 63, the recording paper 5 is not thrust by the transport force of the paper transport roller 63. Hence, the transport force of the intermediate transfer belt 21 decreases contrary to the time of entry of the recording paper 5, and this also causes degradation of image quality, such as a color shift, of images that are being transferred from the photoconductor drums 11 onto the intermediate transfer belt 21 at the first-transfer positions T1.

Accordingly, the present applicant has already proposed an image forming apparatus in order to restrict a color shift of an image by suppressing variation in moving speed of a toner-image carrying member even when plural causes that affect the load on the toner-image carrying member are added.

The proposed image forming apparatus includes a memory that stores a control profile for defining a relation between a position of a recording medium on a transport path and the moving speed of a toner-image carrying member to be set according to the position of the recording medium. By changing the moving speed of the toner-image carrying member according to the control profile acquired from the memory, variation in moving speed of the toner-image carrying body is suppressed to restrict a color shift from occurring to an image.

However, according to the study findings of the present inventor, it was revealed that, since physical properties of the recording paper 5 widely ranged, even when so-called feed-forward control described above was performed according to the control profile, variation in speed of the intermediate transfer belt 21 could not be corrected and a color shift sometimes occurred to an image, depending on the recording paper 5.

Further, according to the study findings of the present inventor, while the basis weight of the recording paper 5 is one factor having a great influence on transportability of the recording paper 5, it is known that transportability of the recording paper 5 is sometimes not determined only by the basis weight. For example, there is recording paper that has a large basis weight of 300 g/m$^2$, but has a low bending strength of 100 gf. In contrast, there is another recording paper that has a basis weight of 270 g/m$^2$ substantially equivalent to that of the above recording paper, but has a high bending strength of 280 gf, which is about three times the bending strength of the above recording paper. Besides the basis weight, the material of paper (for example, coated paper or an OHP sheet) is given as an example of a parameter having an influence on the bending strength of the recording paper 5.

Figure 11:
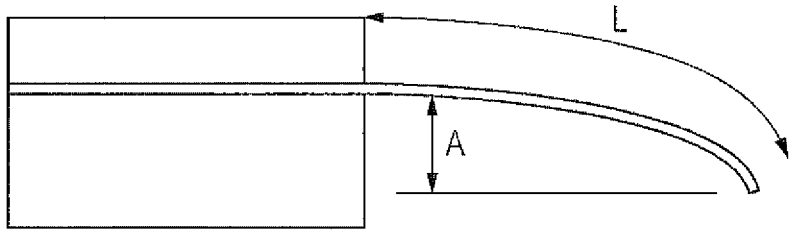
FIG. 11 is a schematic view illustrating a method for measuring the bending strength of paper.

Here, the bending strength (stiffness) of the recording paper 5 refers to stiffness of the recording sheet to be bent. The bending strength is proportional to the elastic modulus and paper width, and is also proportional to the cube of paper thickness. The bending strength (stiffness) of the recording paper 5 is measured, as illustrated in FIG. 11, and is calculated according to the next expression:

$$\text{Bending strength}=(W\times g\times L^4\times H)/(8\times A)$$

where W represents the basis weight of paper (10$^6$ g/mm$^2$), L represents the total length of a drooping portion when one end of the paper placed on a horizontal plane is slid to droop from the horizontal plane, H represents the paper width (mm), and A represents the length by which the droop portion falls in the vertical direction by gravity g.

When recording paper 5 having high bending strength passes through the second-transfer position T2 of the intermediate transfer belt 21, it increases the transport load on the intermediate transfer belt 21. As a result, even when so-called feedforward control is executed according to the control profile, a decrease in moving speed of the intermediate transfer belt 21 cannot be avoided, and a color shift sometimes occurs to an image.

In the first exemplary embodiment, as illustrated in FIG. 4, when recording paper 5 is fed from the manual paper feed device 60, the paper transport roller 55, the paper transport roller 54, and the paper transport roller 63 for transporting the recording paper 5 are disposed upstream of the second-transfer position T2 of the intermediate transfer belt 21. The paper transport roller 63, the paper transport roller 54, and the paper transport roller 55 are provided with first to third release mechanisms 70, 71, and 72, respectively, serving as release units that selectively release contacts for transporting the recording paper 5.

In the first exemplary embodiment, when it is detected that the recording paper 5 is thick paper and/or a recording medium having high bending strength, the first to third release mechanisms 70 to 72 do not release the contacts of the paper transport rollers 63, 54, and 55 with the recording paper 5. Here, for example, thick paper refers to a recording medium having a basis weight of not less than 250 g/m$^2$, and a recording medium having high bending strength refers to a recording medium having a bending strength of not less than 200 gf. When the recording paper 5 is of other types, the contact of the recording paper 5 and the transport rollers is released before a leading edge of the recording paper 5 reaches the transfer portion.

Figure 5:
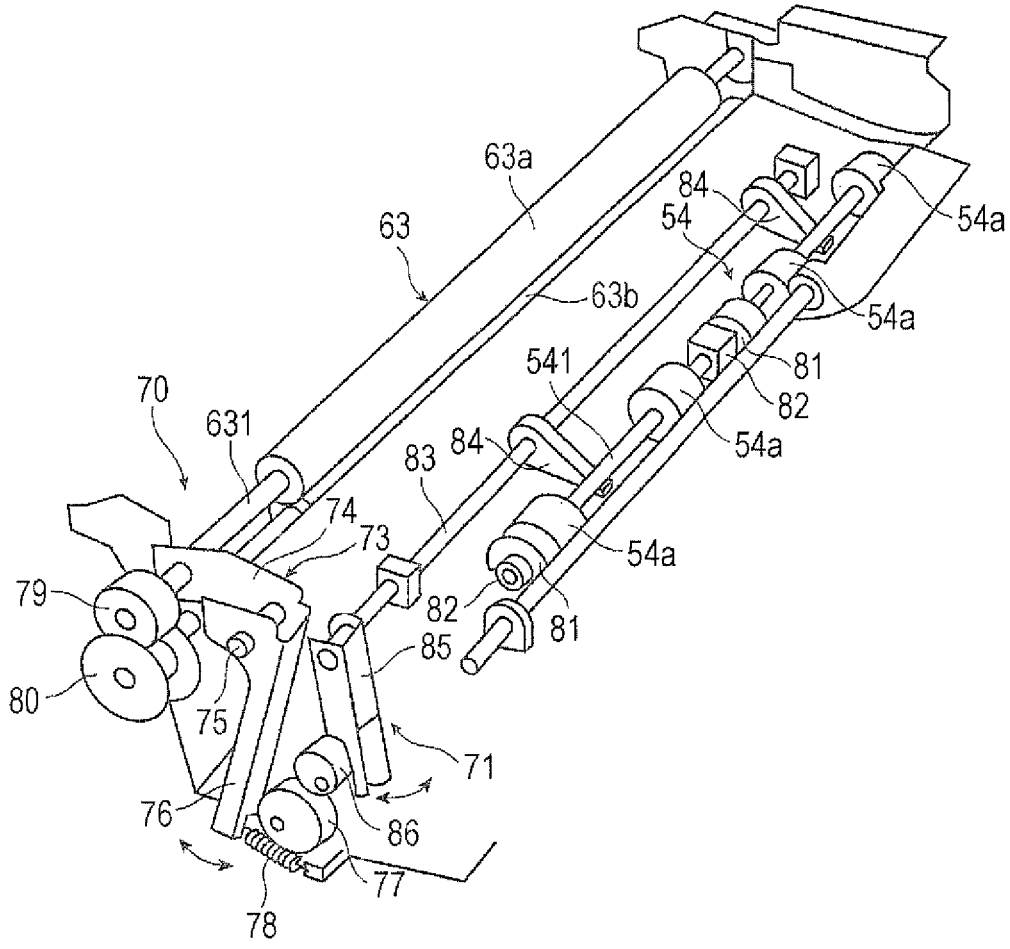
FIG. 5 is a perspective structural view of release mechanisms.

FIG. 5 is a perspective structural view of the release mechanisms in the image forming apparatus 1 of the first exemplary embodiment.

FIG. 5 illustrates the first release mechanism 70 that releases the contact of the paper transport roller 63 located close to the manual paper feed device 60, and the second release mechanism 71 that releases the contact of the paper transport roller 54 (pre-registration roller) located downstream of the paper transport roller 63 in the recording-medium transport direction. The paper transport roller 55 (registration roller) is provided with the third release mechanism 72 having a structure similar to that of the first release mechanism 70. Further, the paper transport roller 53 may also be provided with a release mechanism for releasing the contact.

The first release mechanism 70 includes a first pivot arm 73 and a first eccentric cam 77. The paper transport roller 63 is composed of a first driving roller 63*a* located on an upper side and a second driving roller 63*b* located on a lower side. An end portion of a rotation shaft 631 of the first driving roller 63*a* is rotatably supported by a support arm portion 74 provided in a shorter portion of the first pivot arm 73. The first pivot arm 73 is attached to an unillustrated frame to be pivotal on a pivot point 75 in a direction of arrow. The first pivot arm 73 also includes an operating arm portion 76 extending long in an obliquely downward direction. The first eccentric cam 77 is disposed near a lower end of the operating arm portion 76 to be rotated by an unillustrated driving unit. The operating arm portion 76 is constantly made in contact with the first eccentric cam 77 by tensile force of a coil spring 78. When the first eccentric cam 77 is rotated by the unillustrated driving unit, the first pivot arm 73 pivots clockwise in FIG. 5, and the first driving roller 63*a* supported by the support arm portion 74 of the first pivot arm 73 moves away (upward in FIG. 5) from the second driving roller 63*b*, so that the contact with the recording paper 5 can be released. Driving gears 79 and 80 rotationally drive the first and second driving rollers 63*a* and 63*b*, respectively. While a front side end portion of the first driving roller 63*a* is illustrated in FIG. 5, a depth side end portion thereof is structured similarly.

The second release mechanism 71 includes a second pivot arm 85 and a second eccentric cam 86. The paper transport roller 54 (pre-registration roller) is composed of plural pinch rollers 54*a* (driven rollers) disposed on an upper side, and a driving roller 54*b* disposed on a lower side (see FIG. 4). The pinch rollers 54*a* are separately arranged in an axial direction of a rotation shaft 541. The driving roller 54*b* is shaped like a long column in contact with the pinch rollers 54*a*. The rotation shaft 541 of the pinch rollers 54*a* is rotatably supported via bearing members 82. Also, the rotation shaft 541 of the pinch rollers 54*a* is pressed against the driving roller 54*b* via the bearing members 82 by elastic members 81, such as coil springs, disposed in both end portions and a center portion in the axial direction. Beside the pinch rollers 54*a*, a driving shaft 83 of the second release mechanism 71 is disposed parallel to the rotation shaft 541 of the pinch rollers 54*a*. Lever members 84 are fixed to both end portions in the axial direction of the driving shaft 83. Distal ends of the lever members 84 extend to a lower side of the rotation shaft 541 of the pinch rollers 54*a* such as to be able to lever up the rotation shaft 541.

The second pivot arm 85 is fixed to an end portion of the driving shaft 83. The second eccentric cam 86 is disposed near a lower end of the second pivot arm 85 to be pivoted by the unillustrated driving unit. The second pivot arm 85 is constantly made in contact with the second eccentric cam 86 by an unillustrated elastic member such as a coil spring. When the second pivot arm 85 is pivoted by the unillustrated driving unit, the driving shaft 83 rotates counterclockwise in FIG. 5, and the rotation shaft 541 of the pinch rollers 54*a* is levered up by the lever members 84 attached to the driving shaft 83, so that the pinch rollers 54*a* can be moved away (upward in FIG. 5) from the driving roller 54*b* to release the contact with the recording paper 5. By rotating the driving shaft 83 clockwise in FIG. 5, the lever members 84 are moved down, and the pinch rollers 54*a* are returned into pressing contact with the driving roller 54*b* by the tensile force of the elastic members 81.

The structures of the first and second release mechanisms 70 and 71 are not limited to the illustrated ones, and the first and second release mechanisms 70 and 71 may have other structures, for example, using a driving unit such as a solenoid, as long as they can release the holding forces of the paper transport rollers 63, 54, and 55.

Figure 6A:
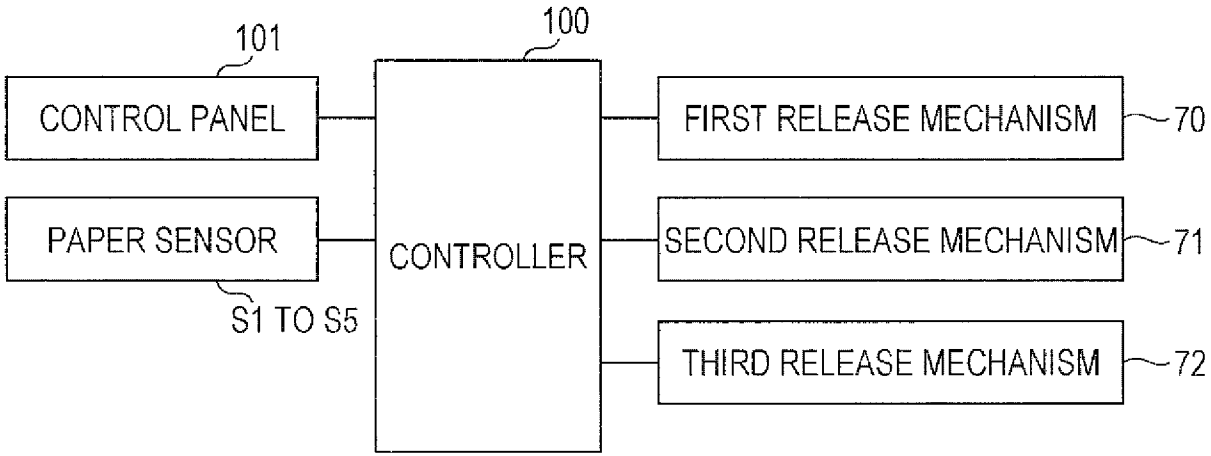
FIG. 6A is a block diagram of a control circuit in the image forming apparatus according to the first exemplary embodiment.
Figure 6B:
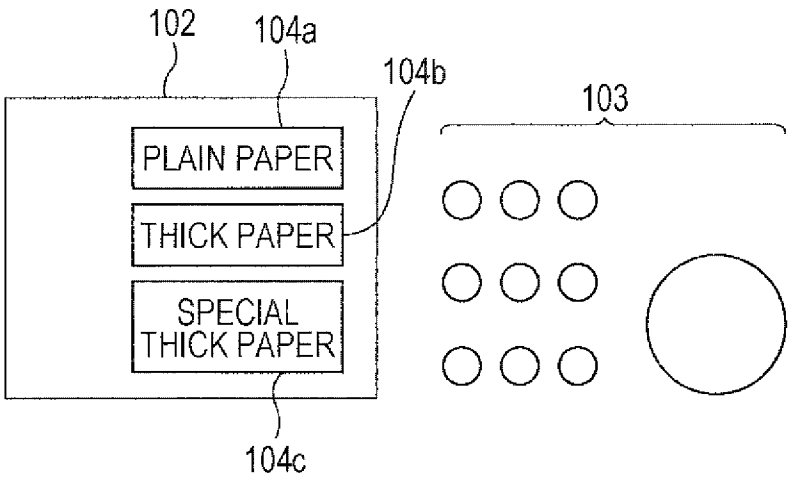
FIG. 6B illustrates a control panel.

FIG. 6A is a block diagram of a controller 100 in the image forming apparatus 1, and FIG. 6B illustrates a control panel 101 in the image forming apparatus 1.

Referring to FIGS. 6A and 6B, the controller 100 includes electronic components such as a CPU and a memory, and generally controls an image forming operation of the image forming apparatus 1 with reference to parameters and the like stored in an unillustrated RAM according to a program stored in an unillustrated ROM. The controller 100 also functions as a switch unit that switches the holding forces of the paper transport rollers 63, 54, and 55 by selectively driving the first to third release mechanisms 70, 71, and 72.

As illustrated in FIG. 6B, the control panel 101 of the image forming apparatus 1 includes a touch panel 102 that also functions as a display for displaying an operation menu, a warning, a message, etc. to the user and that receives various settings for the displayed operation menu, and plural operation buttons 103. The touch panel 102 includes paper setting buttons 104*a*, 104*b*, and 104*c* by which the user selects plain paper, thick paper, and special thick paper, respectively. Here, plain paper refers to recording paper 5 having a basis weight less than 250 g/m$^2$, thick paper refers to recording paper 5 having a basis weight of not less than 250 g/m$^2$, and special thick paper refers to recording paper 5 having a basis weight of not less than 250 g/m$^2$ and a bending strength of not less than 200 gf.

Instead of providing the paper selection buttons 104*a*, 104*b*, and 104*c*, the type of paper (plain paper, thick paper, or special thick paper having high bending strength) may be detected by putting paper in the paper container (paper tray) 51 by the user while recognizing the type of paper. In this case, for example, in a case in which special thick paper is stored in the paper container 51, when the user selects the paper container 51, it is detected that the type of the recording medium is special thick paper having high bending strength.

The controller 100 determines which of the paper selection buttons 104*a*, 104*b*, and 104*c* is operated, and thereby knows which of plain paper, thick paper, and special thick paper having high bending strength is selected as recording paper 5.

In FIG. 6A, S1 to S5 denote paper sensors disposed in the fed-paper transport device 56 and the manual paper feed device 60.

Operation of Characteristic Part of Image Forming Apparatus

When the image forming apparatus 1 according to the first exemplary embodiment receives information about an-image-forming-operation (printing) request command, the controller 100 determines which of plain paper, thick paper, and special thick paper having high bending strength is selected, depending on which of the paper selection buttons 104*a* to 104*c* on the control panel 101 is operated.

Figure 7:
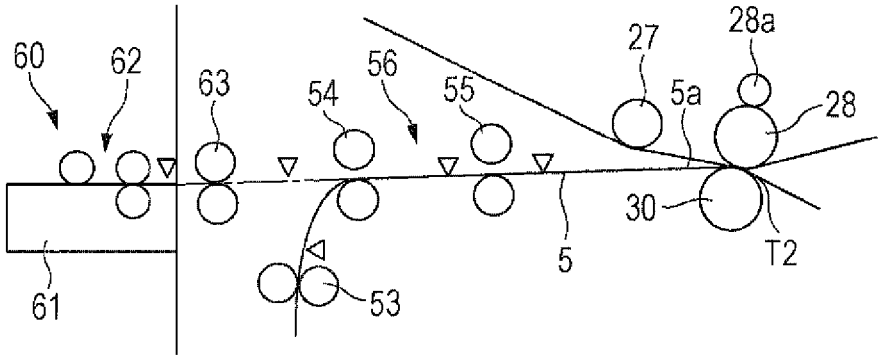
FIG. 7 is an explanatory view illustrating an operation of the image forming apparatus of the first exemplary embodiment.

When determining that the paper selection button 104*a* on the control panel 101 is operated and plain paper is selected as recording paper 5, the controller 100 feeds out plain paper as the recording paper 5 from the paper feed device 50 at a required timing in accordance with an image forming operation. Since the basis weight of plain paper is smaller than that of thick paper, the controller 100 operates the second and third release mechanisms 71 and 72 before a leading edge 5*a* of the recording paper 5 enters the second-transfer position T2 of the intermediate transfer belt 21, as illustrated in FIG. 7. The controller 100 thereby releases the contacts of the paper transport roller 55 and the paper transport roller 54. Then, after the leading edge 5*a* of plain paper serving as the recording paper 5 enters the second-transfer position T2 of the intermediate transfer belt 21, a toner image on the intermediate transfer belt 21 is second-transferred on the recording paper 5 at the second-transfer position T2 and is fixed on the recording paper 5 by the fixing device 40. Then, the recording paper 5 is output to the outside.

The paper transport roller 54 and the paper transport roller 55, whose contacts are released by the second and third release mechanisms 71 and 72, may be contacted again after the leading edge 5*a* of the recording paper 5 passes through the second-transfer position T2 and before the trailing edge of the recording paper 5 passes through the released paper transport rollers 54 and 55.

In contrast, when determining that the paper selection button 104*b* on the control panel 101 is operated by the user and that the manual paper feed device 60 is selected as a paper feed device, the controller 100 executes the following operation. That is, when the controller 100 determines that the manual paper feed device 60 is selected and receives information about an image-forming-operation (printing) request command, it causes the feeding device 62 to start to feed recording paper 5. The controller 100 determines, on the basis of an output signal from the paper sensor S4, that the recording paper 5 made of thick paper is fed from the stacker 61, and transports the recording paper 5 to the second-transfer position T2 of the intermediate transfer belt 21 via the paper transport rollers 63, 54, and 55.

Figure 8:
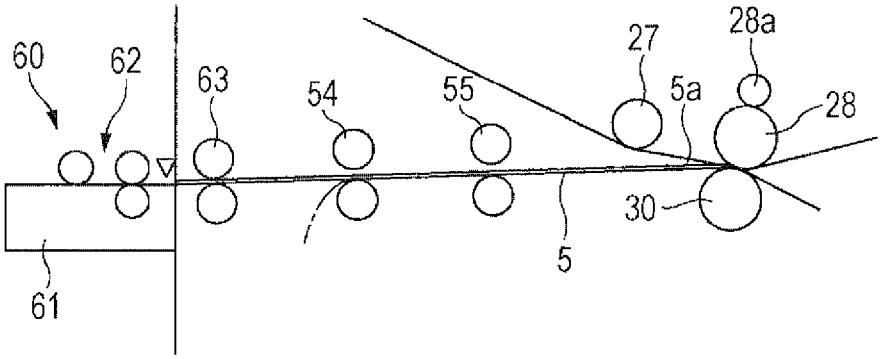
FIG. 8 is an explanatory view illustrating an operation of the image forming apparatus of the first exemplary embodiment.

Immediately before the leading edge 5*a* of the recording paper 5 enters the second-transfer position T2 of the intermediate transfer belt 21, as illustrated in FIG. 8, the controller 100 releases the contacts of the paper transport rollers 54 and 55 by the second and third release mechanisms 71 and 72 on the basis of an output signal from the paper sensor S3, and maintains the contact of the paper transport roller 63 without releasing the contact by the first release mechanism 70.

After that, the recording paper 5 of thick paper is transported by the second transfer roller 30 and the belt support roller 28 via the intermediate transfer belt 21. A toner image is second-transferred from the intermediate transfer belt 21 onto the recording paper 5 of thick paper, and is fixed by the fixing device 40. Then, the recording paper 5 is output to the outside of the apparatus.

In this way, when the recording paper 5 is thick paper, immediately before the leading edge of the recording paper 5 enters the second-transfer position of the intermediate transfer belt 21, the contacts of the paper transport rollers 54 and 55 are released by the release mechanisms while maintaining the contact of the paper transport roller 63. Thus, the recording paper 5 is not thrust by the paper transport rollers 54 and 55. This may prevent the speed of the intermediate transfer belt 21 from increasing when the leading edge 5*a* of the recording paper 5 enters the second-transfer position T2 of the intermediate transfer belt 21, and may prevent or suppressing degradation of image quality, such as a color shift, of images that are being first-transferred from the photoconductor drums 11 to the intermediate transfer belt 21 at the first-transfer positions T1, Further, when the trailing edge of the recording paper 5 passes through the paper transport rollers 54 and 55, it is similarly not thrust by the paper transport rollers 54 and 55. Thus, it may be possible to prevent the speed of the intermediate transfer belt 21 from decreasing and to prevent or suppress degradation of image quality, such as a color shift, of images that are being first-transferred from the photoconductor drums 11 to the intermediate transfer belt 21 at the first-transfer positions T1.

When determining that the paper selection button 104*c* on the control panel 101 is operated by the user, that special thick paper having high bending strength is selected, and that the manual paper feed device 60 is selected as the feeding device, the controller 100 executes the following operation. That is, when the controller 100 determines that the manual paper feed device 60 is selected and receives information about an image-forming-operation (printing) request command, it causes the feeding device 62 to start to feed recording paper 5 made of special thick paper having high bending strength. The controller 100 detects, on the basis of an output signal from the paper sensor S4, that the recording paper 5 made of special thick paper having high bending strength is fed out from the stacker 61, and transports the recording paper 5 by the paper transport rollers 63, 54, and 55 to the second-transfer position T2 of the intermediate transfer belt 21.

Figure 9:
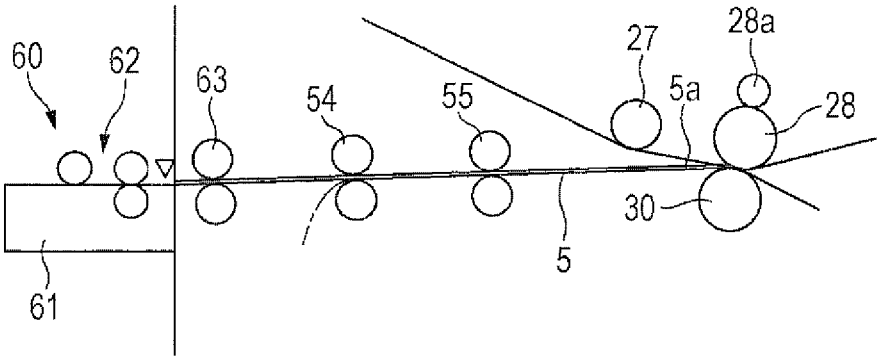
FIG. 9 is an explanatory view illustrating an operation of the image forming apparatus of the first exemplary embodiment.

When determining, on the basis of a detection signal from the paper sensor S3, that a leading edge 5*a* of the recording paper 5 made of special thick paper having high bending strength enters the second-transfer position T2 of the intermediate transfer belt 21, as illustrated in FIG. 9, the controller 100 maintains the contacts of the paper transport rollers 54, 55 and 63 without releasing the contacts by the release mechanisms 70 to 72.

After that, the recording paper 5 is transported by the second-transfer roller 30 and the belt support roller 28 via the intermediate transfer belt 21, and a toner image is second-transferred from the intermediate transfer belt 21 onto the recording paper 5 and is fixed by the fixing device 40. Then, the recording paper 5 is output to the outside of the apparatus by the paper output roller 59.

At this time, in particular, the bending stiffness of the recording paper 5 made of special thick paper having high bending strength is higher than that of thick paper. When the leading edge of the recording paper 5 made of special thick paper enters the second-transfer position of the intermediate transfer belt 21, the transport load on the recording paper 5 increases, and the moving speed of the intermediate transfer belt 21 decreases. Thus, degradation of image quality, such as a color shift, may occur to toner images that are being first-transferred from the photoconductor drums 11 to the intermediate transfer belt 21 at the first-transfer positions.

Accordingly, in the first exemplary embodiment, when the leading edge of the recording paper 5 made of special thick paper having high bending strength enters the second-transfer position T2 of the intermediate transfer belt 21, the contacts of the paper transport rollers 54, 55, and 63 are not released, but are maintained. For this reason, the recording paper 5 made of special thick paper having high bending strength is thrust by the transport force auxiliary obtained by the holding forces of the paper transport rollers 54 and 55 and 63. This may suppress the decrease in speed of the intermediate transfer belt 21. As a result, when an image is formed on the recording paper 5 made of special thick paper, it may be possible to suppress the change, such as decrease, in speed of the intermediate transfer belt 21, and to prevent or suppress degradation of image quality, such as a color shift, of toner images that are being transferred from the photoconductor drums 11 onto the intermediate transfer belt 21 at the first-transfer positions.

Second Exemplary Embodiment

Figure 10:
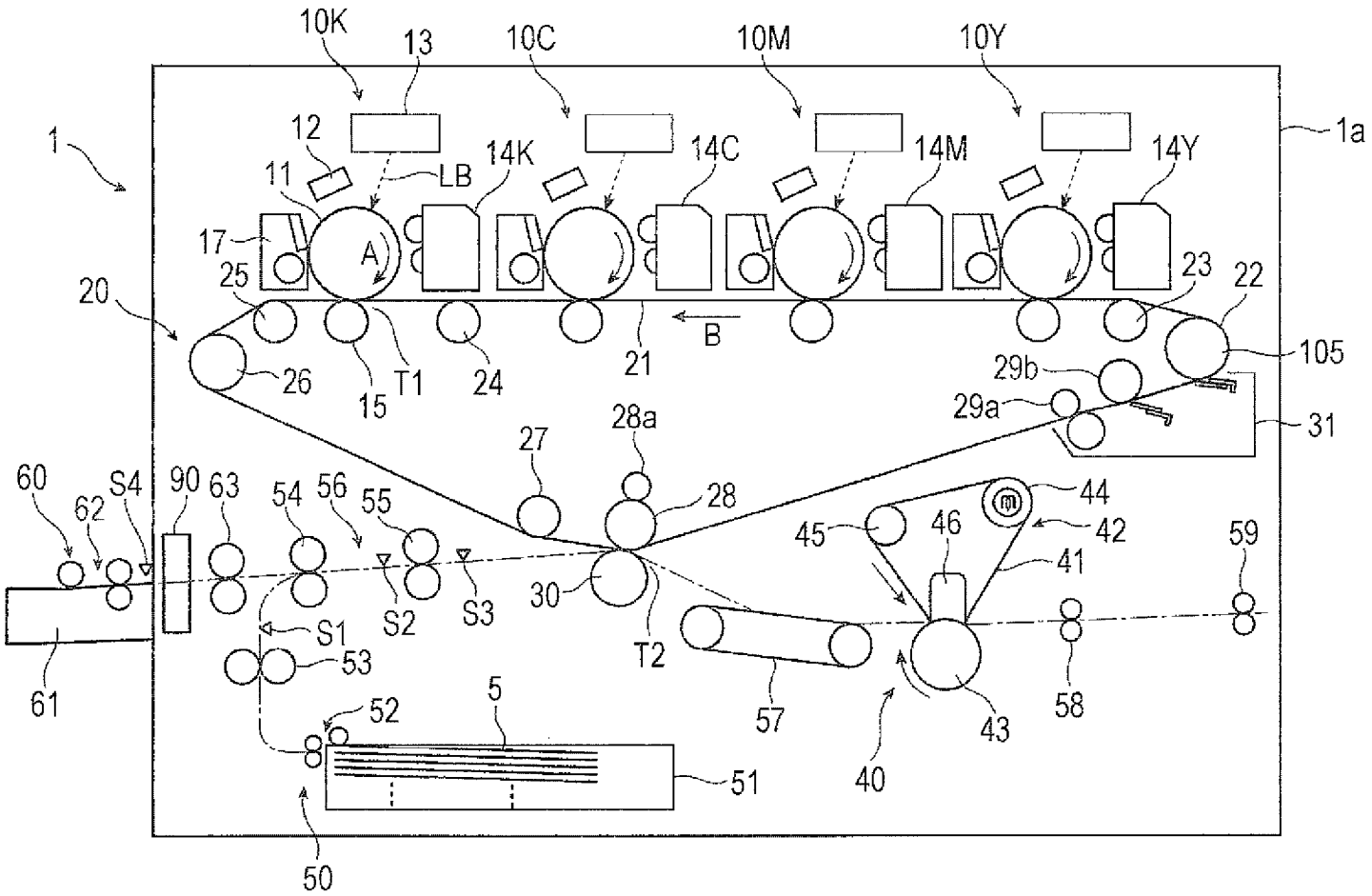
FIG. 10 is a structural view of an image forming apparatus according to a second exemplary embodiment of the present invention.

FIG. 10 is a structural view of an image forming apparatus according to a second exemplary embodiment of the present invention.

As illustrated in FIG. 10, an image forming apparatus 1 of the second exemplary embodiment includes a detector 90 that detects the basis weight and bending strength of recording paper 5 fed from a manual paper feed device 60. For example, the detector 90 detects the thickness of the recording paper 5 by measuring the distance between a pair of rollers that hold the recording paper 5 therebetween. Further, the detector 90 detects the bending strength of the recording paper 5 by measuring reactive force acting on the pair of rollers when the transported recording paper 5 is bent by the rollers.

With reference to an unillustrated table on the basis of the basis weight and bending strength of the recording paper 5 detected by the detector 90, a controller 100 determines which of plain paper, thick paper, and special thick paper the recording paper 5 is.

In this way, in the second exemplary embodiment, the detector 90 is provided to detect the basis weight and bending strength of the recording paper 5. Thus, the user does not need to operate the paper selection button 104*c* on the control panel 101, and this may enhance operability.

The paper transport rollers for maintaining the holding forces are preferably located apart from the second-transfer position T2 of the intermediate transfer belt 21, because the influence of entry of the recording paper 5 to the second-transfer position T2 may be addressed early.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a toner-image carrying member that carries a toner image;

a transfer unit that transfers the toner image carried on the toner-image carrying member onto a recording medium at a transfer portion;

a transport roller disposed along a transport direction to transport the recording medium to the transfer portion of the transfer unit while being in contact with the recording medium; and a release unit that releases the contact of the transport roller with the recording medium, wherein the release unit does not release the contact of the transport roller with the recording medium when it is detected that the recording medium passing through the transport roller is a thick recording medium or a recording medium having a high bending strength, and releases the contact when the recording medium is different from the thick recording medium and the recording medium having the high bending strength, wherein the release unit releases the contact before a leading edge of the recording medium reaches the transfer portion, wherein the thick recording medium is the recording medium having a basis weight of not less than 250 g/m$^2$, and the recording medium having the high bending strength is the recording medium having a bending strength of not less than 200 gf, wherein a plurality of the transport roller are provided, and wherein a number of transport rollers to be in contact with the recording medium increase in an order of plain paper, thick paper, and thick paper having a high bending strength.

2. The image forming apparatus according to claim 1, wherein, when the thickness and a bending strength of the recording medium are more than a predetermined thickness and a predetermined bending strength, the recording medium is transported to the transfer portion without releasing any of the contacts of the plurality of transport rollers with the recording medium.

3. The image forming apparatus according to claim 1, wherein, after the leading edge of the recording medium passes through the transfer portion and before a trailing edge of the recording medium passes through any of the transport rollers whose contact is released by the release unit, the transport roller whose contact is released by the release unit is contacted again.

4. An image forming apparatus comprising:

a toner-image carrying member that carries a toner image;

a transfer unit that transfers the toner image carried on the toner-image carrying member onto a recording medium at a transfer portion;

a transport roller disposed along a transport direction to transport the recording medium to the transfer portion of the transfer unit while being in contact with the recording medium; and a release unit that releases the contact of the transport roller with the recording medium, wherein the release unit does not release the contact of the transport roller with the recording medium when it is detected that the recording medium passing through the transport roller is a thick recording medium or a recording medium having a high bending strength, and releases the contact when the recording medium is different from the thick recording medium and the recording medium having the high bending strength, wherein the release unit releases the contact before a leading edge of the recording medium reaches the transfer portion, wherein a plurality of the transport rollers are provided, and wherein a number of transport rollers to be in contact with the recording medium increases in an order of plain paper, thick paper, and thick paper having a high bending strength.

5. The image forming apparatus according to claim 4, wherein a user selects a thickness of the recording medium.

6. The image forming apparatus according to claim 5, wherein, after the leading edge of the recording medium passes through the transfer portion and before a trailing edge of the recording medium passes through the transport roller whose contact is released by the release unit, the transport roller whose contact is released by the release unit is contacted again.

7. The image forming apparatus according to claim 4, wherein, when the thickness and a bending strength of the recording medium are more than a predetermined thickness and a predetermined bending strength, the recording medium is transported to the transfer portion without releasing any of the contacts of the plurality of transport rollers with the recording medium.

8. The image forming apparatus according to claim 4, wherein, after the leading edge of the recording medium passes through the transfer portion and before a trailing edge of the recording medium passes through any of the transport rollers whose contact is released by the release unit, the transport roller whose contact is released by the release unit is contacted again.

9. An image forming apparatus comprising:

a toner-image carrying member that carries a toner image;

a transfer unit that transfers the toner image carried on the toner-image carrying member onto a recording medium at a transfer portion;

a transport roller disposed along a transport direction to transport the recording medium to the transfer portion of the transfer unit while being in contact with the recording medium; and a release unit that releases the contact of the transport roller with the recording medium, wherein the release unit does not release the contact of the transport roller with the recording medium when it is detected that the recording medium passing through the transport roller is a thick recording medium or a recording medium having a high bending strength, and releases the contact when the recording medium is different from the thick recording medium and the recording medium having the high bending strength, wherein the release unit releases the contact before a leading edge of the recording medium reaches the transfer portion, and wherein, after the leading edge of the recording medium passes through the transfer portion and before a trailing edge of the recording medium passes through the transport roller whose contact is released by the release unit, the transport roller whose contact is released by the release unit is contacted again.

* * * * *